US007954645B2

(12) United States Patent
Kraus

(10) Patent No.: US 7,954,645 B2
(45) Date of Patent: Jun. 7, 2011

(54) VIBRATION SCREEN SYSTEM

(75) Inventor: Richard Kraus, Barrington, IL (US)

(73) Assignee: Dynamic Air Inc., St. Paul, MN (US)

( * ) Notice: Subject to any disclaimer, the term of this patent is extended or adjusted under 35 U.S.C. 154(b) by 212 days.

(21) Appl. No.: 12/283,757

(22) Filed: Sep. 16, 2008

(65) Prior Publication Data

US 2009/0014362 A1 Jan. 15, 2009

Related U.S. Application Data

(62) Division of application No. 11/417,879, filed on May 4, 2006, now Pat. No. 7,467,716.

(60) Provisional application No. 60/795,682, filed on Apr. 29, 2006.

(51) Int. Cl.
*B07B 1/49* (2006.01)

(52) U.S. Cl. ..... 209/399; 209/395; 209/403; 209/404; 209/405

(58) Field of Classification Search ..... 209/274, 209/282, 397, 399, 401, 403, 405, 407
See application file for complete search history.

(56) References Cited

U.S. PATENT DOCUMENTS

| | | | | |
|---|---|---|---|---|
| 339,056 | A * | 3/1886 | Holmes | 209/397 |
| 686,581 | A * | 11/1901 | Brawn et al. | 209/414 |
| 5,051,171 | A * | 9/1991 | Hukki | 209/323 |
| 6,935,511 | B2 * | 8/2005 | Seyffert et al. | 209/404 |
| 6,964,341 | B2 * | 11/2005 | Bacho et al. | 209/405 |

* cited by examiner

*Primary Examiner* — Terrell H Matthews
(74) *Attorney, Agent, or Firm* — Jacobson & Johnson LLC

(57) ABSTRACT

A vibratory plate screen having a first end for quickly mounting in a vibrator housing, an intermediate region with openings therein and a securement end that allows one to quickly secure a vibratory plate screen in a vibratory housing. In addition, the screen is sufficiently flexible to enable one to mount the vibrator screen in a curved condition or stressed condition so that the inherent tensile strength of the material assists in holding the vibratory plate screen in position. A further feature of the invention is the quick removal and securement of the vibratory plate screen.

13 Claims, 6 Drawing Sheets

VIBRATION SCREEN SYSTEM

CROSS REFERENCE TO RELATED APPLICATIONS

This application is a divisional application of U.S. patent application titled VIBRATION SCREEN SYSTEM Ser. No. 11/417,879 filed May 4, 2006 now U.S. Pat. No. 7,467,716 which claims priority from provisional patent application titled VIBRATION SCREEN SYSTEM Ser. No. 60/795,682 filed Apr. 29, 2006.

FIELD OF THE INVENTION

This invention relates generally to screeners and, more specifically, to improvements to screeners and method of making and installing vibratory screens.

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of vibrator housings where screenable material is directed onto a vibratory housing having a screen that allows the smaller screenable material to fall through the screen allows one to quickly and efficiently separate smaller size material from larger size material is known in the art. Typically, a mesh screen is mounted in the housing with the side edges of the mesh screen folded over so that a clamp can secure the side edges of the screen to the sides of the vibratory housing. One of the disadvantages of such vibrator screens is that it is time consuming to change the screen when the screen wears out. Another disadvantage is that such units are prone to retaining material thereon a problem if the material is food or other organic material. Another difficulty is that the screens that are used have a woven pattern and provide high points that can wear quickly thus requiring the screen to be replaced frequently.

SUMMARY OF THE INVENTION

Briefly, the present invention comprises a vibratory plate screen having a first end for quickly mounting in a vibrator housing, an intermediate region with openings therein and a securement end that allows one to quickly secure the vibratory plate screen in a vibratory housing. In addition, the screen can be sufficiently elastic to enable one to mount the vibratory screen in a curved condition or stressed condition so that the inherent modulus of elasticity of the material is sufficient to assist in holding the vibratory plate screen in position. A further feature of the invention is the quick removal and securement of the vibratory plate screen. Other features of the invention are described herein.

DESCRIPTION OF THE PREFERRED EMBODIMENT

Figure 1:
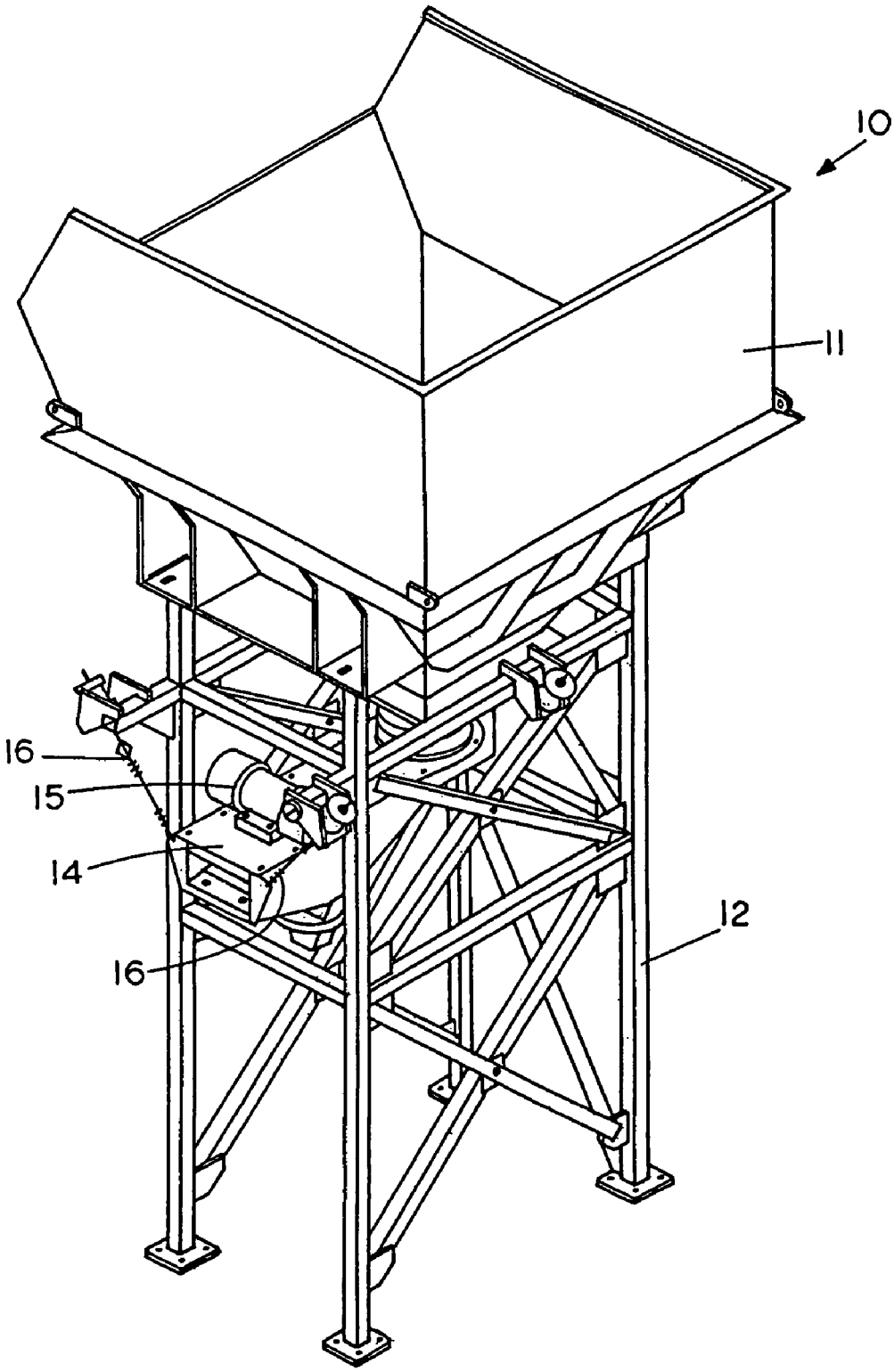
FIG. 1 is a perspective view of a system for vibratory separation of materials.
Figure 2:
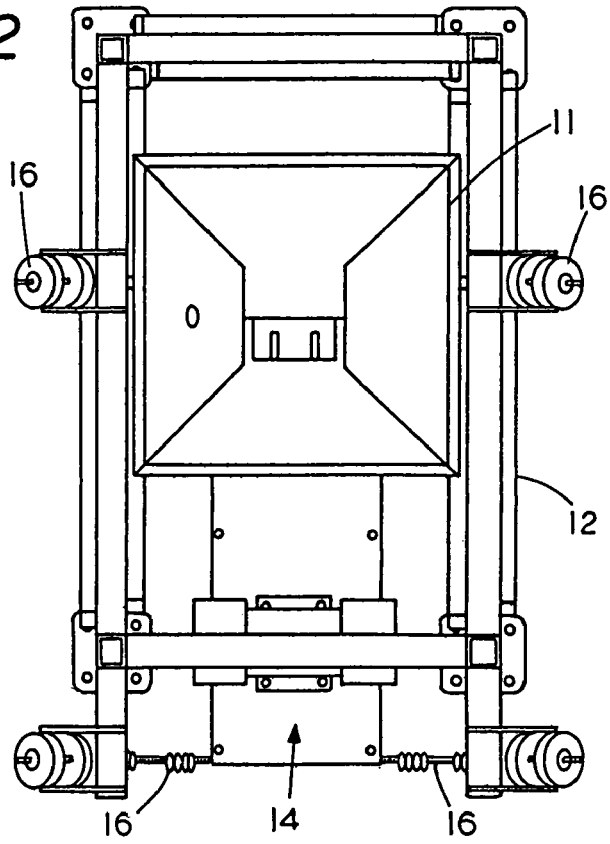
FIG. 2 is a top view of the system of FIG. 1.

FIG. 1 is a perspective view of a system 10 for vibratory separating materials of different sizes and FIG. 2 is a top view of system 10. System 10 includes a stand 12 for supporting a hopper 11 for receiving the material to be separated and a vibratory screener 14 that is supported from stand 12 by a set of four cables and springs 16 that permit vibration of vibratory screener 14 while maintaining the vibratory screener 14 in a position to continually receive material from hopper 11. A vibratory motor 15 is mounted on top of vibratory screen 14 to provide the necessary vibration forces to vibratory screener 14.

Figure 3:
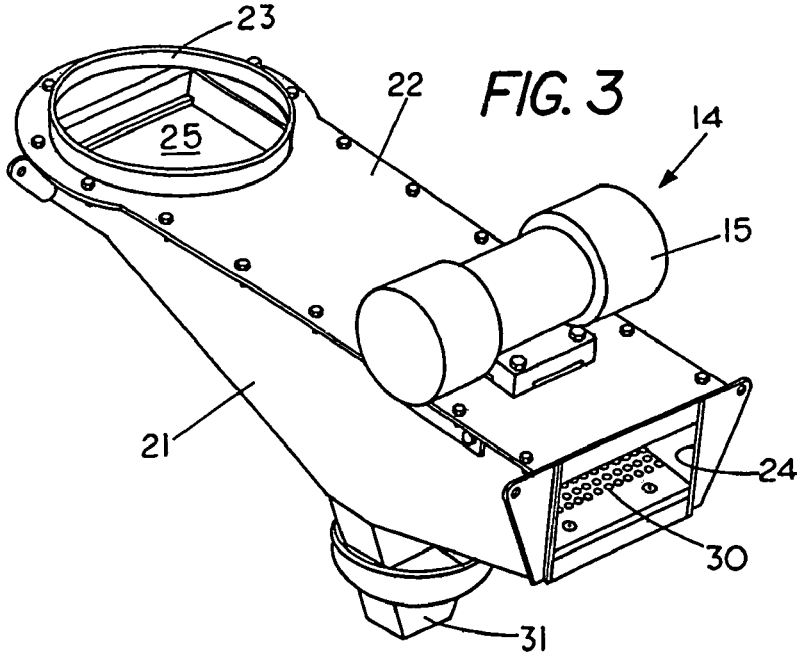
FIG. 3 is an isolated perspective view of a vibratory housing of FIG. 1.
Figure 5:
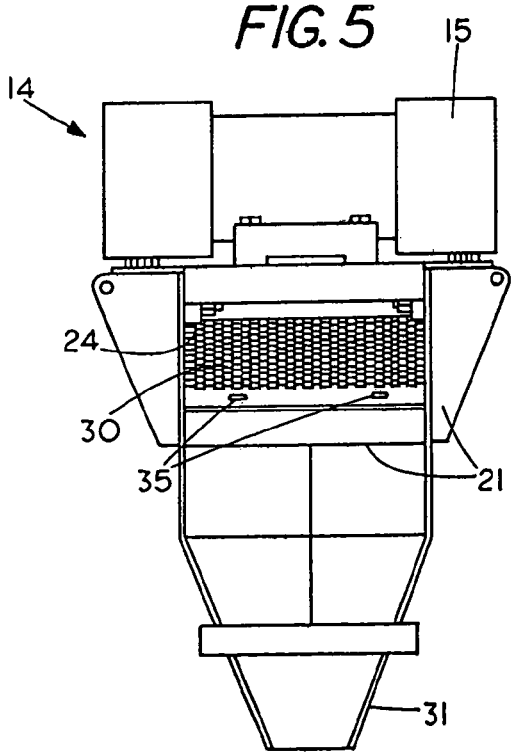
FIG. 5 is an end view of the vibratory housing of FIG. 3.

FIG. 3 shows an isolated perspective view of the vibratory screener 14 and FIG. 5 shows an end view of the vibratory screener 14 with the vibratory screener having a housing 21 comprising a trough or channel like shape and a top member 22 with the top member secured to housing 21 by bolts or the like to form an elongated channel 25 for dispensing materials there through. Located on top of member 22 is a conventional vibratory motor 15 powered from a source (not shown).Vibratory motors typically comprise a motor and a shaft with offset weights on the end of the shaft so that rotation of the shaft produces vibration.

Figure 6:
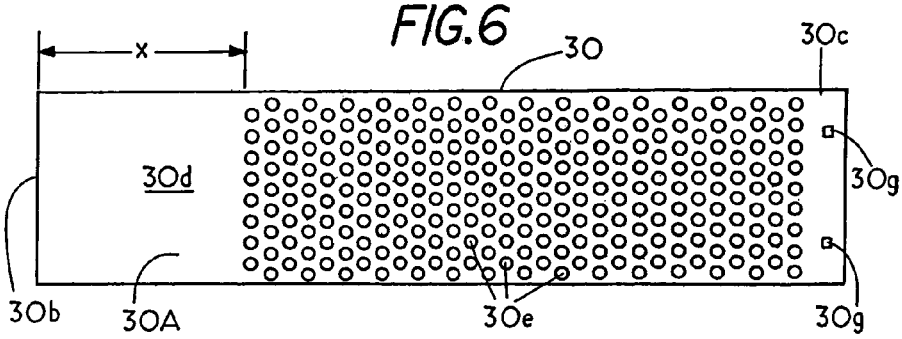
FIG. 6 is a top view of a vibratory screen.

Located in one end of top member 22 is an inlet 23 that allows material from hopper 11 to fall under the influence of gravity onto a receiving region in vibratory plate screen 30. The receiving region 30*d* is shown in FIG. 6 and generally comprises a region that is void of screen openings and preferably extends a distance x so that as the material falls on to the screen from the hopper 11 it does not fall directly onto the screen openings, which could cause material compacting in the openings. However, if material compacting is not a problem in the delivery of materials to the vibratory screener 14 the receiving region could also contain screen openings.

Located on the opposite end of vibratory screener 14 is an outlet 24 for unscreened material and located at the bottom of vibratory screener 14 is an outlet 39 for material that has been screened by virtue of having fallen through a set of screen openings 30*e* in vibratory plate screen 30.

Figure 4:
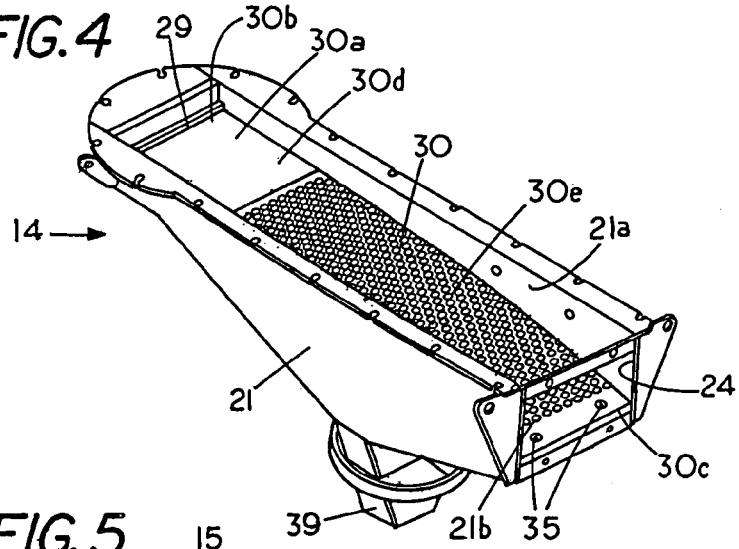
FIG. 4 is an isolated view of the vibratory housing of FIG. 3 with the top member removed.

FIG. 4 shows an isolated view of vibratory screener 14 with the top member 22 removed in order to show the vibratory plate screen 30 mounted in an operational mode. FIG. 6 shows an isolated top view of the vibratory plate screen 30 which is mounted in housing 21.

FIG. 6 shows a vibratory plate screen 30 comprising a metal plate having a top wear surface 30*a*, a first end 30*b* for restraining in one end of housing 21, a second end 30*c* for fixedly securing to the opposite end of housing 21 and an intermediate section therebetween including a receiving region 30*d* and a set of openings 30*e* therein for screening material there through. A set of holes 30*g* allows for insertion of a stud bolt or the like there through to allow vibratory screen 30 to be fixedly mounted in vibratory screener 14.

Figure 7:
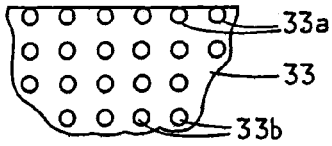
FIG. 7 is a partial top view of the vibratory screen.

FIG. 7 shows an alternate embodiment of a portion of a plate screen 33 that includes a set of openings 33*b* with the openings 33*a* extending to the edge of the plate screen. By having the openings extend to the edge of the plate screen 33 it ensures that materials will not flow along the sides of the screen and thus avoid the screening process.

Figure 3A:
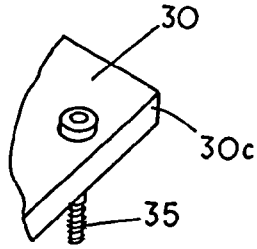
FIG. 3A is a partial view showing the fastener relationship ship for a vibratory screen.

FIG. 3A shows an isolated view of a portion of the vibratory plate screen 30 to show a stud bolt 35 extending through screen opening 30*g* in screen second end 30*c* to fixedly hold the vibratory screen 30 in housing 21. In operation the operator secures stud bolt to member 37 to hold the end of vibratory screen 30 in position. Although a stud bolt is shown other means of fixedly fastening the vibratory plate screen can be used.

In the embodiment shown in FIG. 4 the first end 30*b* is restrained in vibrator housing 21 through coaction of a set of rails and the sidewalls 21*a* and 21*b* of housing 21. FIG. 4 shows the housing sidewalls 21*a* and 21*b* and one rail 29. Rail 29 comprises a cross rail that extends from side to side of housing 21 to restrain vibratory plate screen end 30*b* from vertical displacement. The second end 30*c* of vibratory plate screen 30 is fixedly secured to a cross member 37 (see FIG. 4) by stud bolts 35.

Figure 8:
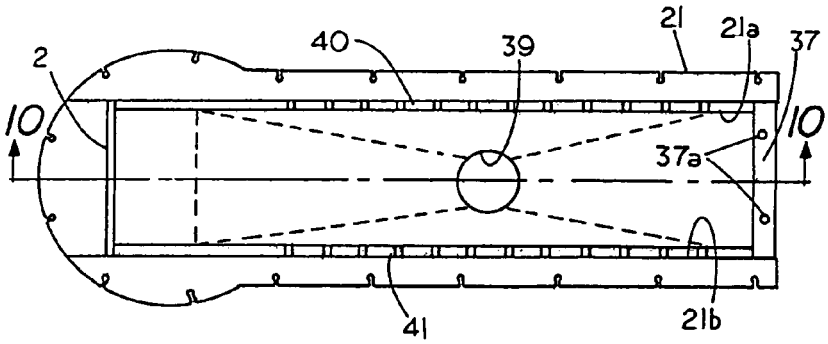
FIG. 8 is a top view of the vibratory screen housing without a vibratory screen therein.

To illustrate the underside peripheral rail support for vibratory plate screen 14 reference should be made to FIGS. 8 to FIG. 10B. FIG. 8 shows a top view of vibratory screen housing 21 without the top member 22 and without the vibratory plate screen 30. Located along side 21*a* of housing 21 is a curved side rail 40 and located along the opposite side 21*b* of housing 21 is a second curved side rail 41. Rail 40 and 41 extend along the sides of housing 21 and are fixedly secured thereto to become side peripheral rail supports for the under side of vibratory plate screen 30. The top cross rail 29 which extends along the end of housing 21 and side rails 40 and 41 comprise a set of rails for restraining vibratory plate screen 30. To fixedly secure the end 30*c* of vibratory plate screen 30 housing 21 includes a cross member 37 having threaded openings 37*a* therein for receiving a stud bolt or the like.

Figure 10:
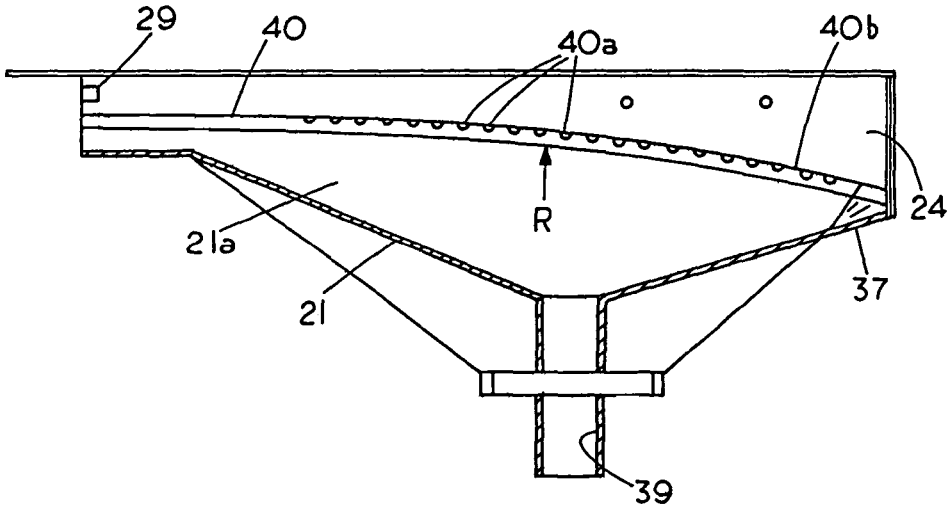
FIG. 10 is a sectional view of the vibratory screen housing taken along lines 10-10 of FIG. 8.
Figure 11:
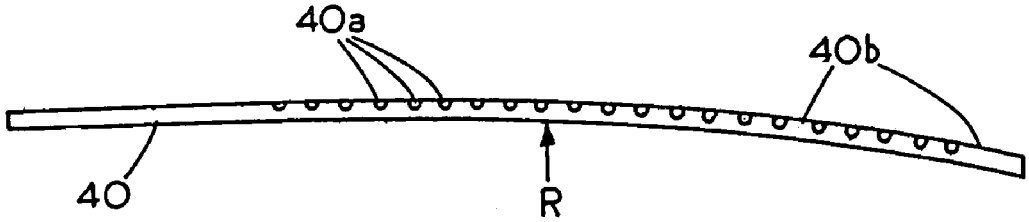
FIG. 11 is an isolated side view of the rail of FIG. 10.
Figure 11A:
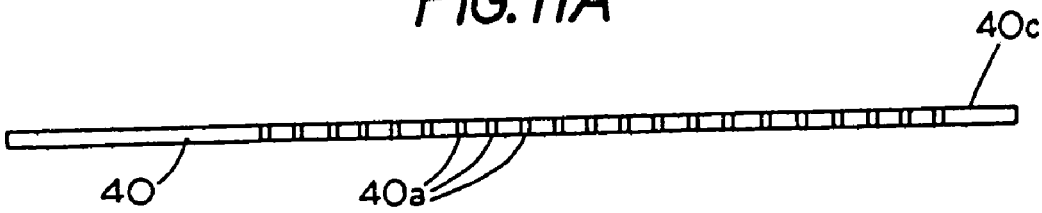
FIG. 11A is an isolated top view of the rail of FIG. 10.

FIG. 10 shows a sectional view taken along lines 10-10 if FIG. 8 to show support rail 40 secured to housing 21 with the rail 40 having a top rail support surface 40*b* with a set of recesses 40*a* therein. Rail 40 provides peripheral side support for one side of vibratory screen 30. Similarly, the rail 41, which is secured to the opposite side of housing 21, provides a peripheral side support for the opposite side of vibratory screen 30. FIG. 11 shows an isolated side view of rail 40 showing that rail 40 is provided with a curvature R and a top surface 40*b* with a set of recess 40*a* located along at least a portion of the top surface. Similarly, FIG. 11A shows an isolated top view of rail 40 which has a planer side 40*c* for securement to the inside side of the vibratory n housing 21 as shown in FIG. 10. As the rail 41 for the opposite side of housing 21 is identical it is not shown in detail.

Figure 9:
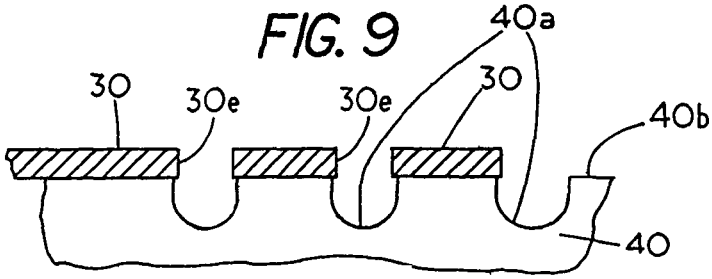
FIG. 9 is a partial view of a vibratory screen and a side rail.

FIG. 9 shows the positioning of the rail recess 40*a* with respect to openings 30*e* in the vibratory screen 30 in a position that inhibits material from adhering to the vibrator housing 21. In the embodiment shown the recess 40*a* on the rails are aligned with openings 30*e* in the screen so that material that falls through screen 30 will have a passageway to the discharge chute 39. The support for vibratory plate screen 30 allows vibratory plate screen 30 to be made with openings that extend from side to side of the vibratory plate screen 30.

Figure 10A:
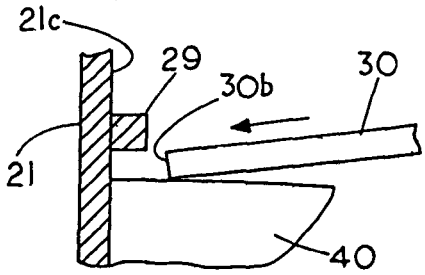
FIG. 10A is a detail showing the insertion of an end of a vibratory plate screen beneath a rail.

One of the features of the invention is the quick mounting of the vibratory plate screen 30. Since vibratory screens are subject to wear as the materials are vibrated thereon the vibratory screens needs to be replaced from time to time. In the present invention one can quickly remove an old vibratory screen and replace it with a new vibratory screen. FIG. 10A shows how end 30*b* of vibratory plate screen 30 is inserted or slid beneath a top cross rail 29 that extends from side to side of housing 21 while using the side rails 40 and 41 as guides.

Figure 10B:
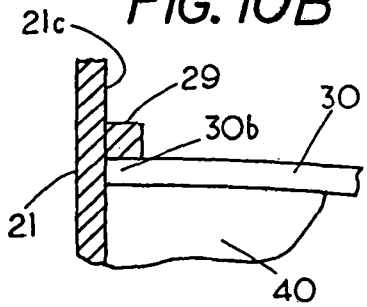
FIG. 10B is a detail view showing the end of the vibratory plate screen positioned in the installed condition.

FIG. 10B shows the end 30*b* of vibratory plate screen 30 supported vertically by rail 40 and top rail 29. While the end 30*b* can be slid in or out of the spacing between rails 29*a*the screen 30 is restrained from lateral movement by the sides of housing 21 and from vertical movement by the rail 29.

A further feature of the invention is the rail support of vibratory plate screen 30 that allows removable fasteners on end 30*c* to secure the vibratory plate screen in fixed position during vibratory screener. The rails allow for removal and replacement of the vibratory plate screen 30 through the open end or outlet 24 of housing 21. That is, the stud bolts 35 are located at a discharge outlet 24 and are accessible to an operator. Once the stud bolts 35 are removed one can slide the vibratory plate screen 30 out of the housing 21 since the set of rails do not longitudinally restrain vibratory plate screen therein.

A further feature of the invention is the stress mounting of the vibratory plate screen 30 to ensure that the vibratory plate screen dynamically moves back and forth with the vibrations induced in the vibratory housing 21.

Figure 6A:
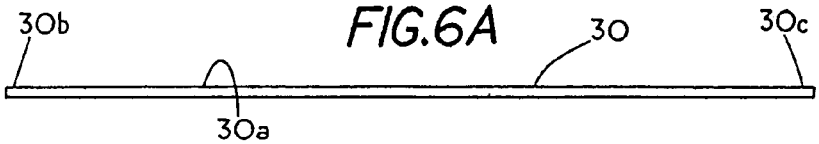
FIG. 6A is a side view of the vibratory screen of FIG. 6.

A reference to FIG. 10 shows a curvature R to the rail 40 and a reference to FIG. 6A shows a side view of vibratory plate screen 30 in a planar or flat condition with essentially an infinite radius of curvature. Thus there exists a difference in the radius of curvature of the side rail supports and the vibratory plate screen 30. In the stress installation mounting of the end 30*b* of vibratory plate screen 30, which has a first radius of curvature that is different from the radius of curvature of the rails, the end 30*b* is inserted beneath rails 29 as shown in FIG. 10A. Next, the operator grasps the end 30*c* of vibratory plate screen 30 and with a downward force on the topside of vibratory screen 30 forces screen 30 against cross member 37 (see FIG. 8) bringing the radius of curvature of the vibratory plate substantially equal to the radius of curvature of the side rails. This produces stress in vibratory plate screen causing the cross rail 29 and the side rails to vertical restrain the vibratory plate screen. Once in the stress mounting position the side rails 40 and 41 provide vertical peripheral side support and the sides of housing 21 namely, 21*a* and 21*b* can assist in laterally restraining screen 30. When the vibratory screen 30 is in forced to conform to the curvature of side rails 40 and 41 the stud bolts 35 are inserted through openings 30*g* (see FIG. 6) and into the member 37*a* (see FIG. 8) to secure the vibratory plate screen 30 in a flexed or curved condition in housing 21.

While a stress mounting of the vibratory plate screen 30 has been shown it should be understood that the vibratory plate screen could also be secured without stress mounting.

Thus with the use of removable fasteners on only one end of the vibratory screen 30 the vibratory screen can be brought into a fixed support in housing 21. That is, as the vibratory screen is subject to vibration and shaking it is necessary to hold the screen firmly in position in the housing. By use of a rail on one end and on the sides, which combined with the stress, mounting of the screen 30 allows the screen 30 to be firmly held in position by fasteners located only at the discharge end of the screen 30.

Once the screen is in position the vibratory motor 15 shakes or vibrates the vibratory screener 14 thus causing materials to flow along the vibrator 25 in the vibratory screener 14 with the smaller sized materials falling through screen 30 and the larger materials flowing along the screen 30 and discharge from the outlet 24.

Thus the invention includes a two phase method of mounting a vibratory plate screen in a vibratory housing comprising the steps of slideably positioning a first end 30*b* of the vibratory plate screen 30 into engagement with a set of rails 29, 40 and 41 on the vibratory screener housing 21; and fixedly securing a second end 30*c* of the vibratory plate screen 30 to the vibratory screen housing 21. In addition by applying a face force i.e. a force perpendicular to the second end 30*c* of the vibratory plate screen while restraining the first end 30*a* with the set of rails one can bring the second end into a securable position.

To provide for ease installing the vibratory plate screen the step of restraining the first end includes inserting the first end beneath an end rail 29 which is spaced sufficiently far apart from the side rails 40 and 41 so as to form a snug but non-interference fit there between.

Thus in one embodiment the vibratory plate screen comprises a plate having a top wear surface 30*a*, a first end 30*b*, a second end 30*c* and an intermediate region with openings 30*e* therein for screening material therethrough with the first end 30*b* slideably engageable with a vibratory housing rail 29 and the second end 30*c* fixedly securable to a vibrator housing 21 to thereby secure the vibratory plate screen 30 in an operational mode. By forming the screen from a flat metal plate the vibratory plate screen can include a top surface 30*a* of the vibratory plate screen which lies in a single plane with the vibratory plate screen free of protrusions. Thus, the vibratory plate screen has a first radius of curvature but is sufficiently flexible so as to flex into a second radius of curvature when secured to a vibratory housing.

I claim:

1. A vibratory screener comprising:

a hopper for holding a material to be separated;

a vibratory screener housing having an inlet for receiving the material to be screened, said housing having a top rail and a set of curved side rails;

a vibratory plate screen located in said housing wherein said set of curved side rails are located underneath the vibratory plate screen and said top rail is located above a first end of the vibratory plate screen for vertically restraining said vibratory plate screen and a fastener for securing a second end of said vibratory plate screen to said housing, said vibratory plate screen having a set of openings extending from side-to-side of said vibratory screener housing with said housing and said vibratory plate screen forming an unimpeded flow channel from the inlet to an outlet of the vibratory screen housing and the set of openings diverting material therethrough as the vibratory plate screen is vibrated.

2. The vibratory screener of claim 1 wherein the set of curved side rails have a radius of curvature different from a radius of curvature of the vibratory plate screen when the vibratory plate screen is in a relaxed condition.

3. The vibratory screener of claim 2 wherein the radius of curvature of the side rails and the radius of curvature of the vibratory plate screen are substantially the same when the vibratory plate screen is in a stressed condition.

4. The vibratory screener of claim 1 wherein the set of curved rails and the top rail are located on opposite sides of the vibratory plate screen with the set of curved rails and the top rail supporting at least three peripheral edges of the vibratory plate screen when the vibratory plate screen is in a stressed condition.

5. The vibratory screener of claim 1 wherein the vibratory plate screen is restrained from removal from the vibratory housing by fasteners located in an open end of said vibratory plate screen.

6. The vibratory screener of claim 1 wherein the edges of the vibratory plate screen are only supported from beneath the vibratory plate screen to inhibit material from being retained along a side edge of the vibratory plate screen.

7. A vibratory screener comprising:

a vibratory housing having an end rail, a set of curved side peripheral rails secured thereto and an open end;

a vibratory plate screen having a top wear surface, a first end, a second end and an intermediate region with openings therein for screening material therethrough; and a cross member located proximate said open end in said vibratory housing with said first end of the vibratory plate screen supported by an underside of said end rail and said intermediate region supported in a curved condition on a top surface of said set of curved side peripheral rails with said second end of the vibratory plate screen removably secured side of the cross member for replacement of the vibratory plate screen though the open end of said vibratory housing.

8. The vibratory screener of claim 7 wherein the vibratory plate screen has a set of openings extending from side to side of said vibratory plate screen and the set of curved side peripheral rails includes a set of recesses therein to inhibit material from adhering to the vibratory plate screen.

9. The vibratory screener of claim 7 wherein the vibratory plate screen comprises a metal plate having a uniform thickness and having a set of openings extending from side to side of said vibratory plate screen.

10. The vibratory screener of claim 7 wherein a top surface of the vibratory plate screen secured to the vibratory housing lies in a single plane before securement to the vibratory housing and in a curved condition after securement to the vibratory housing and the vibratory plate screen is free of protrusions.

11. The vibratory screener of claim 7 wherein the vibratory plate screen has a first radius of curvature and is sufficiently flexible so as to flex into a second radius of curvature when secured to the vibratory housing, where the first radius of curvature is different from the second radius of curvature.

12. The vibratory screener of claim 8 including an inlet on one end of said vibratory housing and an outlet on the opposite end of said vibratory housing.

13. The vibratory screener of claim 12 including a discharge chute located below said vibratory plate screen.

* * * * *